United States Patent [19]

Klingel

[11] 4,285,374

[45] Aug. 25, 1981

[54] MOBILE WOOD SPLITTER

[76] Inventor: Edward R. Klingel, 405 Poplar St., Stroudsburg, Pa. 18360

[21] Appl. No.: 75,680

[22] Filed: Sep. 14, 1979

[51] Int. Cl.[3] ..... B27L 7/00

[52] U.S. Cl. ..... 144/193 A

[58] Field of Search ..... 144/193 R, 193 A; 280/481; 180/53 C

[56] References Cited

U.S. PATENT DOCUMENTS

| | | | |
|---|---|---|---|
| 3,319,675 | 5/1967 | Bles, Sr. | 144/193 A |
| 3,356,115 | 12/1967 | Cole | 144/193 R |
| 3,588,147 | 6/1971 | Enters | 280/481 |
| 3,760,854 | 9/1973 | Worthington | 144/193 A |
| 3,938,567 | 2/1976 | Dircksen et al. | 144/193 A |
| 4,116,251 | 9/1978 | Graney | 144/193 R |

*Primary Examiner*—W. D. Bray

*Attorney, Agent, or Firm*—Harvey B. Jacobson

[57] ABSTRACT

A single steel wedge is mounted on one end of an I-beam base. A hydraulic cylinder is attached to the opposite end of the base and has its piston connected to a power ram which is slidably attached to the top surface of the I-beam base. A pair of removable legs are mounted to the bottom surface of the base and the entire wood splitter is mounted on an A frame which is adapted for connection to the front end of any vehicle that is equipped to handle snow removal equipment.

1 Claim, 4 Drawing Figures

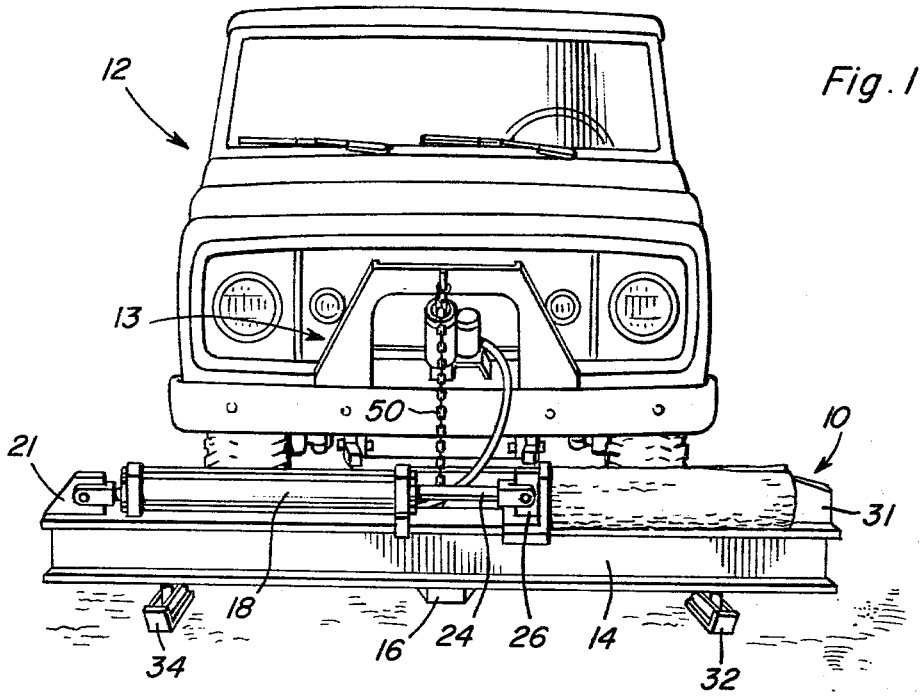
Fig. 1
Fig. 2
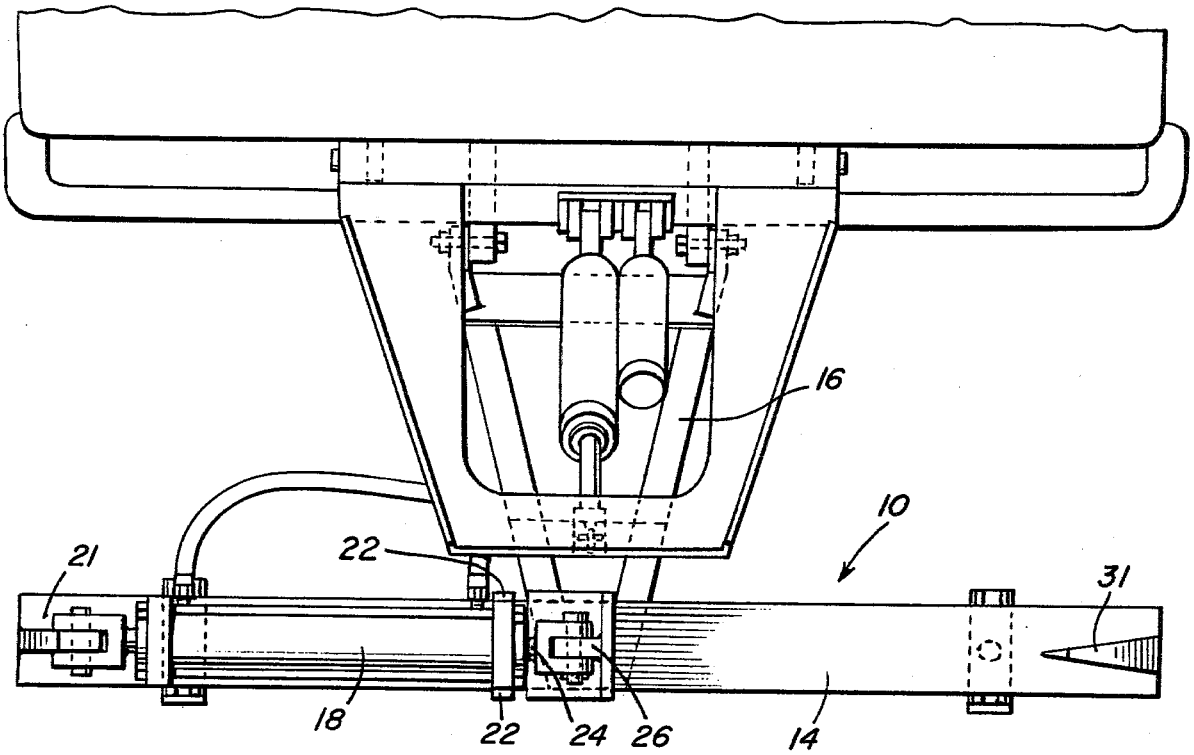

MOBILE WOOD SPLITTER

BACKGROUND OF THE INVENTION

1. Field of the Invention

This invention relates to log splitting devices and especially to such devices which are adapted to be carried by an existing hitch mechanism of a motor vehicle.

2. Discussion of the Related Art

Many types of wood splitters have been suggested. These devices are normally adapted for attachment to trucks, tractors and other motor vehicles. Further, the known devices include splitters disposed in horizontal or vertical operational positions and include moving splitting wedges or rams which move the wood into contact with the stationary wedge. However, no presently available splitter includes a combination of elements which make the wood splitter rugged, easy to operate and able to be connected quickly and easily to a motor vehicle without obtaining special permits, licenses, separate running lights, separate brakes or trailer hook-ups. U.S. Pat. No. 3,356,115, issued Dec. 5, 1967, to Cole, shows an apparatus for splitting logs in the form of a mobile unit provided with a pair of wheels mounted on an axle which supports a frame in a horizontal position in line with the center of the wheels. A cylinder is mounted centrally of the frame and actuates a ram through fluid pressure. Logs are forced against the cutting edge of a member for splitting through force of the ram. U.S. Pat. No. 3,760,854, issued Sept. 25, 1973, to Worthington, shows a log splitter which includes a ground engageable beam with a hydraulic cylinder on the upper beam surface. The splitter is detachably connected for transportation to a vehicle such as a tractor and is positioned at one end of the vehicle longitudinally aligned therewith. U.S. Pat. No. 4,116,251, issued Sept. 26, 1978, to Graney, shows a log splitter having a stationary edge and a movable ram mounted on an elongated I-beam track. The track is supported on a pair of bases for holding the track in ground engaging disposition when in use.

SUMMARY OF THE INVENTION

One object of the present invention is to provide a mobile wood splitter which can be transported on the front end of any vehicle that is equipped to handle snow removal equipment without having to obtain any permits, licenses, separate running lights, special brakes or trailer hook-ups.

A further object of the present invention is to provide a mobile wood splitter having detachable ground support legs to that the height of the splitter from the ground can be adjusted.

A still further object of the present invention is to provide a mobile wood splitter having a minimum number of operating components to provide a splitter which is rugged, yet efficient in use and easily operated.

In accordance with the above objects, the mobile wood splitter of the present invention includes a horizontally disposed I-beam base connected to an A frame having three mounting points for attachment to a motor vehicle with the base disposed transversely of the vehicle. A pair of removable feet are mounted to the bottom of the I-beam and a hydraulic cylinder is mounted to the top of the I-beam. A ram is attached to a clevis mounted on the piston of the hydraulic cylinder and a sharpened splitting wedge is attached on one end of the base in alignment with the ram. The A frame can easily be attached to a standard hydraulic lift mounted on motor vehicles for use with snow removal equipment. The entire wood splitter has a length less than eight feet and is thus capable of being carried on public highways when mounted transversely of the motor vehicle.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the mobile wood splitter mounted to a motor vehicle.

FIG. 2 is a top plan view of the wood splitter of FIG. 1.

DETAILED DESCRIPTION OF THE PREFERRED EMBODIMENTS

Figure 4:
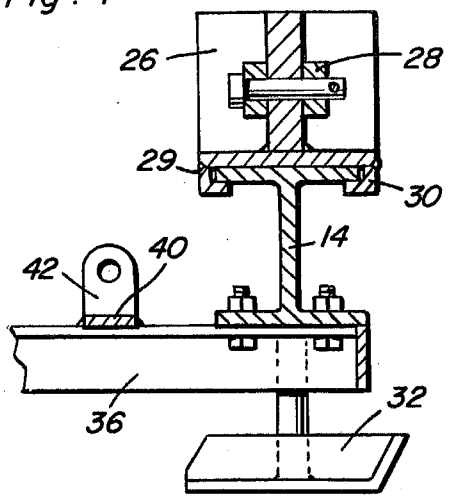
FIG. 4 is an end elevational sectional view taken substantially along a plane passing through section line 4—4 of FIG. 3.
Figure 3:
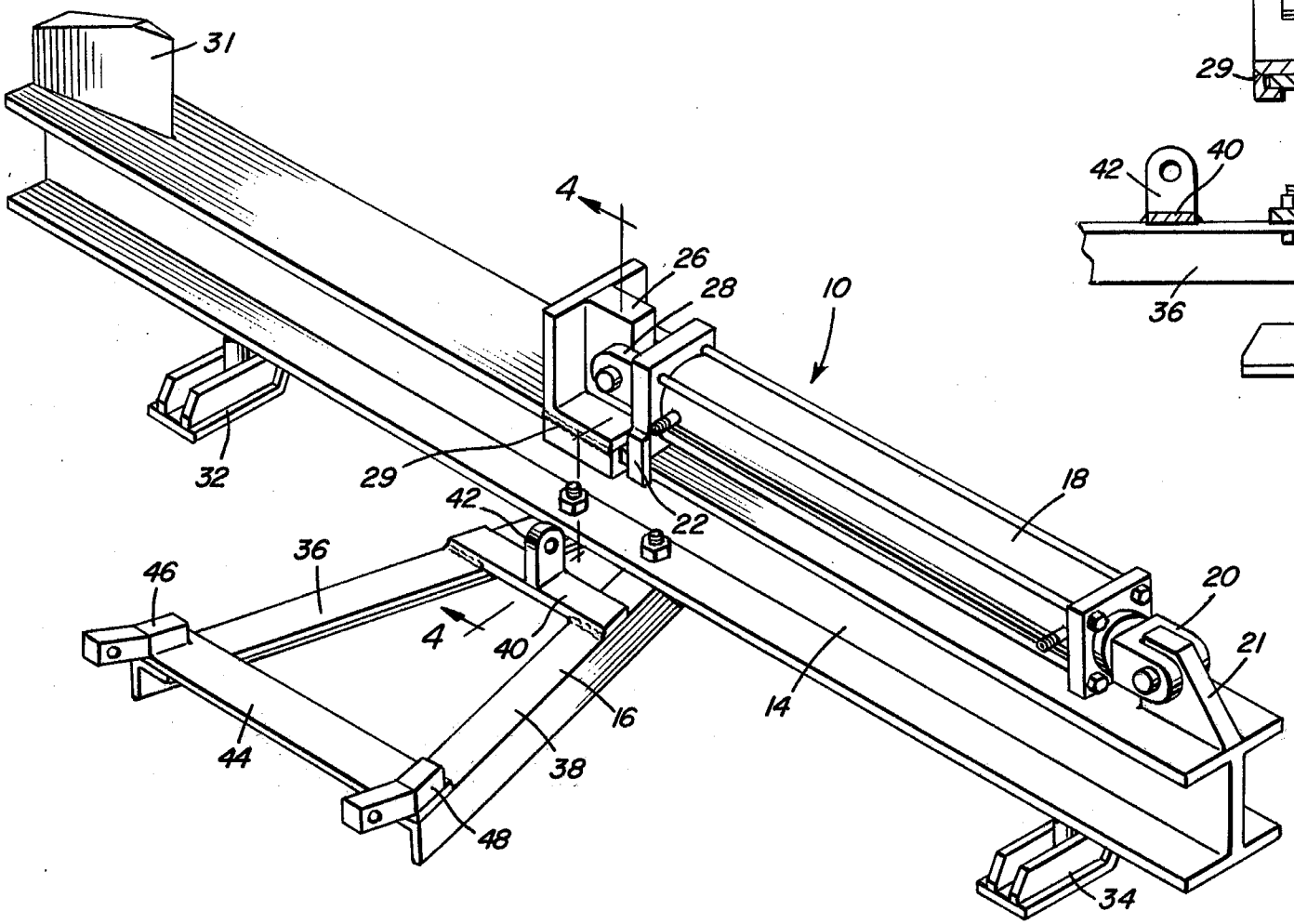
FIG. 3 is a perspective view of the mobile wood splitter.

Now with reference to the drawings, a mobile wood splitter incorporating the principles and concepts of the present invention and generally referred to by the reference numeral 10 will be described in detail. The wood splitter is designed to be attached to a motor vehicle such as that shown at 12 which includes a hydraulic lift mechanism 13 attached to the front end of the vehicle and adapted to handle snow removal equipment. The wood splitter 10 is mounted transversely of the vehicle and is preferably 6½ feet in length thus enabling it to be transported by the vehicle along highways without requiring the use of special permits, or the like. Further, the wood splitter 10 extends forwardly of the vehicle by, preferably, 28 inches and thus can be transported without the necessity of attaching separate running lights or other indicia to the device. At the same time, the wood splitter is able to be easily maneuvered on the vehicle to a ground engaging position for splitting logs and the like. The wood splitter includes a base 14 which mounts the actual splitting mechanism. The base 14 is attached to an A frame 16 for mounting to the vehicle 12.

Base 14 is preferably in the form of an I-beam with the splitting mechamism mounted on the top surface of the beam. The splitting mechanism includes hydraulic cylinder 18 mounted to the base through clevis 20 which is attached to an upstanding anchor bracket 21 affixed to the top surface of the I-beam base 14. Cylinder 18 can be operated through use of the existing hydraulic pump of vehicle 12. At the end of the cylinder opposite clevis 20, there are a pair of clips 22 which are attached in a depending relationship to the cylinder and which abut the sides of the base 14. Clips 22 serve to maintain the cylinderin lateral alignment to the base to prevent buckling of the cylinder and cylinder piston during high pressure splitting operations. The piston 24 of cylinder 18 is connected to ram 26 through clevis 28. The ram has a substantially flat front face for contacting a log to be split and a substantially flat base which rests upon the top of I-beam base 14. A pair of guides 29 and 30 which encompass the outer edges of the top of I-beam 14 to maintain the ram 26 in alignment thereon. At the opposite end of the base 14 from the mounting of bracket 21 is the steel cutting wedge 31 which faces ram 26. Obviously, the wood to be split is placed between ram 26 and wedge 31 at which time cylinder 18 is actuated extending the piston 24. This causes engagement of the wood with the wedge 31 which splits the wood.

When in use, it is preferable that the wood splitter 10 be resting on the ground to insure adequate support and stability of the device. For this reason, a pair of legs 32 and 34 are attached to the bottom of base 14 to support the base. Legs 32 and 34 should preferably be mounted by the use of bolts or the like in order that the legs can be removable to adjust the height of the wood splitter from the ground.

The A frame 16 used to mount the wood splitter on lifting mechanism 13 of vehicle 12 comprises a pair of diverging legs 36 and 38 which are attached to each other at one end. The attached end of legs 36, 38 are bolted to the underside of base 14. Each leg 36, 38 can be formed preferably of angle members to insure rigidity and adequate support for the wood splitter. A central cross member 40 is attached between the legs and is connected to an upstanding mounting bracket 42. A second cross member 44 connects the legs at their divergent ends and a pair of laterally aligned mounting brackets 46 and 48 are connected to these ends. Mounting brackets 46 and 48 are pivotally attached to the frame of vehicle 12 while mounting bracket 42 is attached to lift chain 50 of the hydraulic lift cylinder of lifting mechanism 13. Accordingly, the entire wood splitter can easily be raised and lowered as desired.

As such, it can be seen that the mobile wood splitter can be adapted to most four-wheel drive and two-wheel drive pick-ups, jeeps, etc., that have existing snow removal equipment by mounting the A frame 16 to the hydraulic lift system of the vehicle and including a two-way valve control to extend and react the piston 24. Optional quick disconnect or screw-type couplings can be used.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A log splitting device for attachment to a motor vehicle, said log splitting device comprising:

an elongated rigid base member, said base member including an I-beam having a topmost flanged portion onto which a log to be split may be positioned;

a ram slidingly mounted to a first end of said topmost flanged portion of said I-beam, said ram including an upstanding plate abuttable against a first end of said log and a piston member pivotally attached to said upstanding plate for facilitating a horizontal sliding movement of said plate along said topmost flanged portion of said I-beam;

hydraulic power means operably connected to said piston member for facilitating said horizontal movement of said plate, said hydraulic power means including a hydraulic cylinder having one end pivotally attached to said topmost flanged portion of said I-beam, said piston member operably extending from and being movable relative to a second end of said hydraulic cylinder;

a cutting wedge member operably attached to a second end of said topmost flanged portion of said I-beam, said cutting wedge member being abuttable against said second end of said log whereby said log may be forced against said wedge member in response to an extending movement of said piston member from said hydraulic cylinder to thereby facilitate the splitting of said log;

first guide means associated with said hydraulic cylinder, said first guide means being fixedly attached to said hydraulic cylinder and being abuttable against said topmost flanged portion of said I-beam to prevent a lateral displacement of said hydraulic cylinder from said topmost flanged portion, said first guide means including a pair of downwardly extending clips which overlap an edge portion of said topmost flanged portion of said I-beam so as to permit a vertical upward movement of said hydraulic cylinder while preventing any lateral movement thereof;

second guide means associated with said upstanding plate, said second guide means being fixedly attached to said upstanding plate and being slidably engageable with said topmost flanged portion of said I-beam so as to prevent both lateral and vertical displacement of said upstanding plate and said piston member from said topmost flanged portion of said I-beam, said second guide means including a pair of downwardly extending and inturned guide members which serve to overlap said edge portions of said topmost flanged portion of said I-beam so as to prevent both vertical and lateral movement of said upstanding plate;

a mounting frame connectible to a motor vehicle and having said I-beam fixedly secured thereto, said mounting frame including a pair of diverging legs, each having first ends fixedly securable to a bottommost flange of said I-beam and being further secured together by first and second cross members, said first cross member having a first mounting bracket extending upwardly therefrom, said first mounting bracket serving as a connection means for a chain hoist means, said second cross member having a pair of second mounting brackets extending laterally therefrom, said second mounting brackets being attachable to a structural member of said motor vehicle; and a pair of leg members extending downwardly from said I-beam to support said log splitting device from a supporting surface when in use.

* * * * *